United States Patent [19]

Jones

[11] 4,338,705

[45] Jul. 13, 1982

[54] METHOD AND APPARATUS FOR REMOVING TRASH FROM MATERIAL

[75] Inventor: Joseph K. Jones, Raleigh, N.C.

[73] Assignee: Cotton Incorporated, New York, N.Y.

[21] Appl. No.: 118,977

[22] Filed: Feb. 6, 1980

[51] Int. Cl.[3] ..... D01G 9/00

[52] U.S. Cl. ..... 19/80 R; 19/87; 19/107; 19/200

[58] Field of Search ..... 19/41, 80 R, 82, 83, 19/85, 87, 93, 97.5, 107, 200, 202, 204

[56] References Cited

U.S. PATENT DOCUMENTS

| | | | |
|---|---|---|---|
| 211,757 | 1/1879 | McAuley . | |
| 631,800 | 8/1899 | Lemoine | 19/85 |
| 1,259,243 | 3/1918 | Keough | 19/85 |
| 1,449,392 | 3/1923 | Freeman | 19/80 R |
| 1,479,537 | 1/1924 | Garner | 19/87 |
| 1,667,505 | 4/1928 | Assiter | 19/85 |
| 1,714,953 | 5/1929 | Hancock | 19/93 |
| 2,152,140 | 3/1939 | Gilbert | 15/90 |
| 2,185,408 | 1/1940 | Kettenbach | 83/28 |
| 2,348,597 | 5/1944 | Booth | 19/66 |
| 3,486,309 | 12/1969 | Wild | 19/107 X |
| 3,559,804 | 2/1971 | Lytton | 19/93 |
| 4,154,021 | 5/1979 | Griffith et al. | 19/41 X |

FOREIGN PATENT DOCUMENTS

| | | | |
|---|---|---|---|
| 821422 | 10/1959 | United Kingdom | 19/107 |
| 2010936 | 7/1979 | United Kingdom | 19/107 |

*Primary Examiner*—Louis Rimrodt

*Attorney, Agent, or Firm*—Burns, Doane, Swecker & Mathis

[57] ABSTRACT

The present disclosure relates to a method and apparatus for separating trash from irregularly-shaped clusters of material containing trash, fiber motes, and cotton lint. The apparatus comprises a rotatable drum encircled by a screen. The drum contains a plurality of finger-shaped baffles preferably arranged in two rows disposed 180° apart on the inner periphery of the drum. As material is delivered to the rotating drum, the finger-shaped baffles lift and tumble the clusters of material and pull the material apart to separate the heavy trash. The heavy trash drops through the screen and is removed by a conveyor. The fiber motes and cotton lint, along with smaller trash, are retained within the rotating drum and removed at an outlet end of the drum.

16 Claims, 2 Drawing Figures

METHOD AND APPARATUS FOR REMOVING TRASH FROM MATERIAL

BACKGROUND AND SUMMARY OF THE PRESENT INVENTION

The present invention relates to a method and apparatus for removing trash from material. More particularly, the present invention relates to removing heavy trash from formerly waste material containing trash, cotton lint, and motes.

During cotton ginning and early textile mill processing, a substantial quantity of good fiber is usually discarded with the trash. Much of this cotton fiber is contained in cotton motes. Cotton motes are those cotton fiber aggregates which are sufficiently dense to be discarded with the trash in conventional cleaning processes. The trash includes such particles as stems, burrs, leaf particles, etc. In order to more effectively utilize the fiber contained within the waste material, it is necessary to remove a substantial quantity of the heavy trash before attempting any further processing of the material.

Therefore, it is an object of the present invention to provide a method and apparatus which will effectively separate the heavy trash from waste material discarded by cotton gin and early textile mill processing.

It is a further object of the present invention to provide an apparatus which removes heavy trash and is simple in operation and construction and can easily be installed in existing cotton processing plants.

These and other objects of the present invention are satisfied by providing an elongated drum with a plurality of finger-shaped baffles arranged on the inner periphery of the drum. The drum is surrounded by a screen having a small opening size to permit the heavy trash to fall through while retaining the motes and some lighter trash. The drum is slowly rotated in order to lift and tumble the material over the finger-shaped baffles.

In a preferred embodiment of the present invention, the plurality of baffles are arranged in two rows disposed 180° apart along the inner periphery of the drum. The baffles are arranged in such a manner that the incoming material is balanced upon the top of the baffles and is pulled apart as the drum rotates. This lifting and dropping action combined with the rotation of the drum acts similar to a vibratory action and tends to separate the trash from the material.

It is further preferred that two rotating drums be provided to increase the efficiency of the apparatus. Also, the trash which drops through the screen is picked up by a conveyor and delivered to a trash disposal system. The present invention could also be utilized in the commonly-assigned copending application of Winch et al for "Total Fiber Recovery Method and Apparatus".

BRIEF DESCRIPTION OF THE DRAWINGS

These and other objects of the present invention will become apparent to those skilled in the art with reference to the accompanying drawings which illustrate the preferred embodiment of the present invention wherein like members bear like reference numerals and wherein.

DETAILED DESCRIPTION OF THE PREFERRED EMBODIMENT

Figures 1, 2:
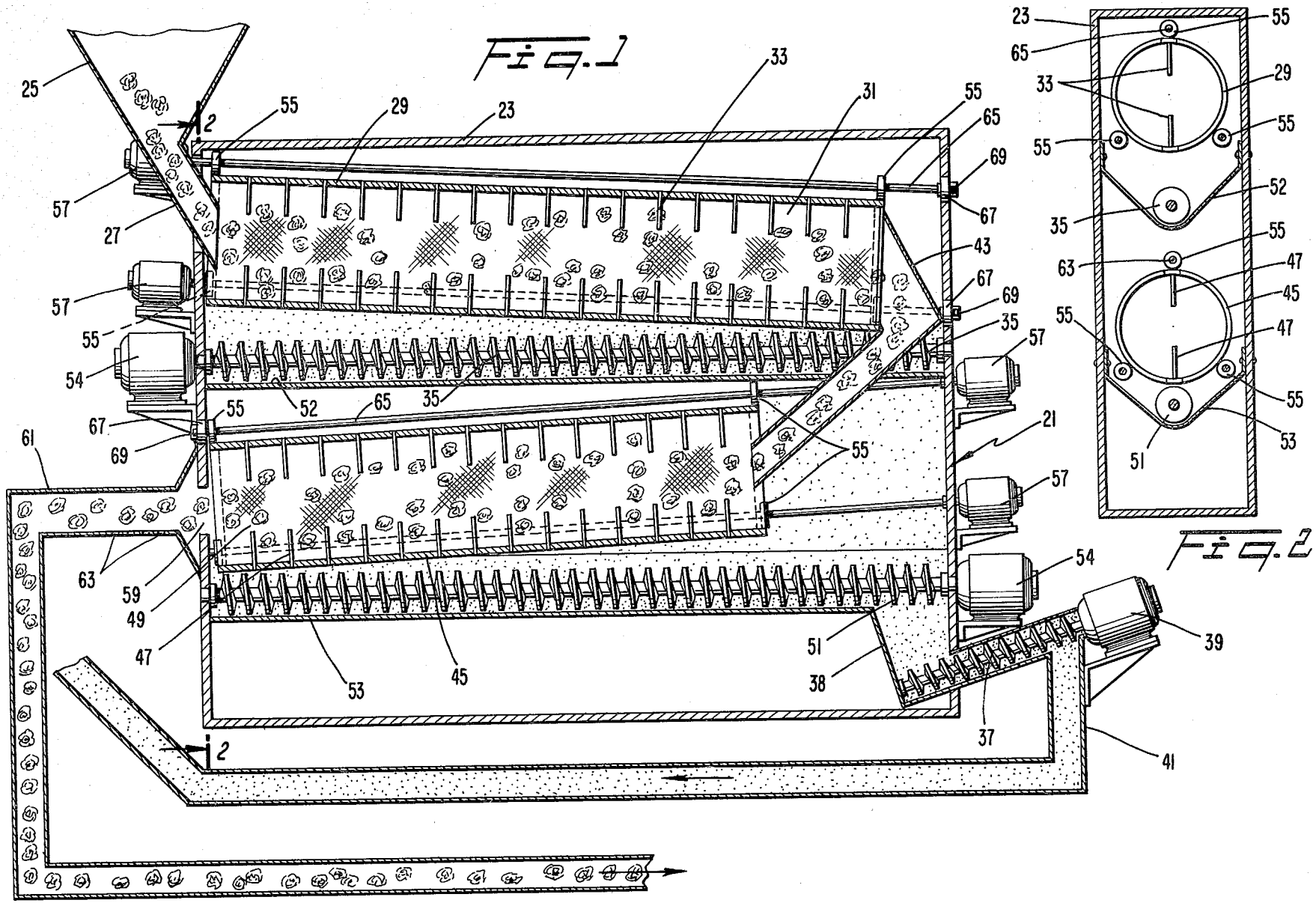
FIG. 1 is a simplified cross sectional view of the apparatus according to the present invention.
FIG. 2 is a view taken substantially along the line 2—2 in FIG. 1.

With reference to FIG. 1, an apparatus according to the present invention, called for convenience a drum screen cleaner, is generally indicated by reference numeral 21. The drum screen cleaner 21 includes a housing 23. Waste material containing trash, motes, and cotton lint from an early textile or ginning process is first fed into a long body cyclone 25 of a suitable design in which air is removed from the waste material and the waste material is formed into irregularly shaped clusters. The clusters of waste material leaving the cyclone 25 are fed through a line 27 which passes through the housing 23 into a first elongated rotary drum 29 of the cleaner. The drum 29 includes a screen 31 around the periphery thereof. Under slight negative pressure, the clusters of material are tumbled to shake out the heavier trash particles as explained in more detail below. The negative pressure is obtained by withdrawing air through a vent (not shown) in the cleaner housing 23. The slight negative pressure also operates to aid in the removal of dust and lint fly generated in the drum screen cleaner.

On the inner circumference of the first drum 29, a plurality of finger-shaped baffles 33, i.e., elongated thin rods, are arranged in two rows disposed 180° apart. Within each row, the baffles are arranged parallel to one another along radii of the first drum. In a preferred embodiment, each of the baffles is made from $\frac{1}{4}$-inch round stock which is cut to a length of approximately 6 inches. The baffles are preferably spaced approximately 6 inches apart along the horizontal length of the drum. As illustrated in FIG. 1, the baffles of one row are disposed along substantially the same diameter as corresponding baffles of the other row. Alternatively, the baffles of one row could be arranged along diameters lying to either side of the baffles of the other row in an axial direction.

The baffles 33 lift the clusters of material during rotation of the drum 29 about the axis of the drum and drop or tumble the clusters of material onto the screen 31, similar to a vibratory action. The finger-shaped baffles 33 are spaced sufficiently far apart to allow the clusters of material to pass therebetween so that the clusters will continue to be tumbled and lifted by the other baffles to aid in pulling the clusters of material apart for greater opening and better heavy trash removal. The amount of lift imparted to the clusters of material by the baffles 33 depends upon the size and shape of the incoming material and also upon how well the material is picked up and/or balanced upon individual baffles. The pulling action caused by the baffles 33 tends to break up the material and free a large percentage of the trash. The continuous action of the baffles 33, as the drum 29 rotates and the material moves by gravity through the first drum 29, breaks up the clusters of material to expose more trash and allow the trash to drop out through the screen 31.

The heavy trash which drops through the screen 31 of the first drum 29 is collected by a first screw conveyor 35 disposed underneath the first drum 29. The trash collected on the first conveyor 35 moves from left to right as seen in FIG. 1 and is discharged downwardly by gravity and eventually picked up by a conveyor 37 driven by any suitable device 39 and delivered through a line 41 to any suitable trash disposal system. The conveyor 37 is arranged in an angled container 38 which aids in directing the trash towards the conveyor 37.

The material retained by the first drum 29 moves through a line 43 to a second drum 45 containing a second plurality of baffles 47 similar to the baffles 33 in the first drum 29. Once again, a lifting and tumbling action occurs as the second drum 45 rotates to separate more trash from the material. The heavy trash which drops through a screen 49 encircling the second drum 45 is collected on a second screw conveyor 51. The trash is transported by the screw conveyor 51 to the conveyor 37 which removes the trash to the trash disposal system (not shown). The screw conveyors 35, 51 are driven by any suitable drive mechanism 54. Angled metal sheets 52, 53 are disposed beneath the first and the second screw conveyors 35, 51 respectively in order to ensure that the trash is transported to the right as seen in FIG. 1 and dropped onto to the conveyor 37.

Each of the first and the second drums 29, 45 are friction-driven through a plurality of driven rollers 55 (FIG. 2). Each drum is driven at its inlet end through a suitable driving device schematically shown by reference numerals 57. This driving device could, for example, be an electric motor or a belt drive from any other power plant. Also, the drive device could be interconnected with the drive mechanism 54 for the screw conveyors 35, 51. At least one of the rollers on each drum may be mounted on a cam arm which is spring loaded (not shown) to maintain the drums in proper alignment and in driving contact with the rollers 55. Either the rollers may be composed of a suitable rubber-like material or rubber belting may be provided on the portion of the drums in contact with the rollers to provide greater friction and to reduce noise. The driving mechanism may operate through one or more of the rollers on each drum.

In a preferred embodiment, it has been found preferable for the openings in the screens 31, 49 surrounding the drums 29, 45 to be approximately $\frac{1}{4}$ of an inch in diameter. The screen opening may be of any suitable shape, (e.g., square, round, etc.). The size of approximately $\frac{1}{4}$ of an inch in diameter allows the heavy trash to drop through and be removed by the screw conveyors 35, 51 while the fiber motes are retained. If a larger opening size is employed the motes would tend to fall through the screen with the trash. If a smaller opening size were employed, sufficient heavy trash would not be removed. The motes and light trash retained by the first and the second drums 29, 45 of the drum screen cleaner are removed through an opening 59 in the housing 23 at the outlet end of the second drum 45.

The motes and lighter trash which do not drop through the screens are removed from the outlet 59 of the cleaner by air admitted through openings 63 in a line 61. This material, which is only partially cleaned, is preferably subjected to further fine opening and cleaning in order to provide usable cotton fiber from the motes. The outlet 59 may alternatively be disposed at the outlet of the first drum if only one drum is desired.

The method and apparatus of the present invention removes the heavy trash particles so that the retained material can be more easily cleaned and opened without subjecting the subsequent fine opening and cleaning devices to the detrimental effects of a substantial quantity of trash particles. In other words, the drum screen cleaner of the present invention is essentially a coarse cleaner.

The first and the second drums 29, 45 are also preferably provided with a mechanism for adjusting the angle of tilt between the inlet and the outlet ends of the respective drums. As shown in FIG. 1, shafts 65 which carry the rollers 55 extend through slots 67 in the housing 23 and are secured by nuts 69. In this way, the outlet end of each drum may be adjusted relative to a horizontal plane by loosening the nuts 69 and manually raising the drum. A suitable seal may be provided in the slots 67 about the shafts 65 to prevent dust from escaping through the slots and to maintain the slight negative pressure within the housing 23. Alternatively, each drum may be arranged in an individual frame which is adjustable by any suitable apparatus.

The adjustment in the angle of the drums is desirable in order to control the amount of time during which the material remains within the drums. As the volume of material deposited in the drum increases, the angle of the drums with the horizontal is decreased since the material itself develops a flow line within each of the drum which creates an increased slope towards the outlet end of the drum. In a preferred embodiment, each of the drums is adjustable from a horizontal position to a position where a vertical drop of approximately 6 inches occurs from the inlet to the outlet end of each drum.

Also, in the illustrated embodiment, the first drum 29 is approximately 10 feet long and 2 feet in diameter, while the second drum 45 is approximately 8 feet long and 2 feet in diameter. For these drum sizes, 6-inch diameter screw conveyors have been found to be appropriate. Also in a preferred embodiment, the two drums are rotated at a speed between 24–30 r.p.m.

It may be preferable to arrange the shorter drum above the longer drum. Among other advantages, this arrangement would permit the line 43 to be arranged centrally from the outlet of the first drum to the inlet of the second drum instead of towards the right or the left of the first screw conveyor 35 as in the illustrated embodiment. The relative length of the drums is not critical to the operation of the present invention and the drums could be constructed to be substantially the same length if desired.

In operation, the waste material is delivered to the long body cyclone 25. Air is separated from the waste material and the material is formed into irregular shaped clusters. The clusters of material are then moved by gravity and dropped into the first drum 29 where, due to the rotation of the drum, the clusters of the material are lifted, balanced and tumbled on the first plurality of baffles to break up and pull apart the clusters of material and separate the trash. The relatively heavy trash drops through the screen 31 while the lighter trash and fiber motes are retained within the drum 29. Having moved through the first drum 29 by gravity, the remaining material is conducted through the line 43 by gravity into the second drum 45. Due to the rotation of the second drum 45, the material is lifted and tumbled over the second plurality of finger-shaped baffles 47 to further break up the clusters of material and separate the trash. The relatively heavy trash drops through the screen 49 and is transported away by the second screw conveyor 51.

The trash particles conveyed by the first screw conveyor 35 and the second screw conveyor 51 are dropped by gravity into the receiver 38 where the trash is picked up by the conveyor 37 and transported through line 41 to a trash disposal system. The material remaining at the outlet 59 of the second drum 45 is transported in the line 61 by air introduced through the holes 63 to a further processing station.

As can be seen, the present invention provides a coarse cleaning for cotton containing waste material which effectively removes a substantial quantity of heavy trash. This trash removal permits the remaining material to be subjected to fine opening and cleaning at subsequent stations to obtain usable cotton fiber. The plurality of finger-shaped baffles disposed on the inner periphery of each of the rotating drums effectively pull apart the clusters of material allowing the heavy trash to drop away from the cotton motes. It is the continuous lifting, tumbling, and pulling action imparted by these finger-shaped baffles which produces the desired cleaning effect.

It is preferred that prior to subjecting the waste material to the action of the drum screen cleaner 21 that longer fibers remaining in the waste from cotton gin or early textile mill processing be removed. In this way, the drum screen cleaner can be most effectively used to separate the trash from the short fibers and motes. There will be less likelihood of nepping or entanglement of the fibers about the baffles during tumbling if the longer fibers have been previously removed.

As pointed out above, the length of each baffle and the spacing between adjacent baffles is arranged such that the lifting and tumbling action can be imparted to a great majority of the clusters of material. By providing two rotating drums, the efficiency of the drum screen cleaner is enhanced.

The principles and preferred embodiments of the present invention have been described in the foregoing specification. However, the invention which is intended to be protected is not to be construed as limited to the particular embodiments disclosed. It will be apparent to those skilled in the art that numerous modifications, variations, substitutions, and equivalents exist for features of the invention described herein, which do not materially depart from the scope of this invention. The embodiments disclosed are to be regarded as illustrative rather than restrictive. Accordingly, it is expressly intended that all such modifications, variations, substitutions, and equivalents which fall within the spirit and the scope of the invention as defined in the appended claims be embraced thereby.

What is claimed is:

1. A method of removing trash from a material comprising the steps of:

feeding the material to an inside of a drum having a screen surrounding the drum;

rotating the drum;

cyclically lifting the material toward an upper portion of the drum and dropping the material directly onto the screen at a lower portion of the drum with a plurality of finger-shaped baffles arranged in two parallel rows disposed 180° apart within the drum and arranged parallel with each other with each of the baffles comprising an elongated thin rod extending inwardly along a radius of the drum to break up clusters of material and separate the trash;

producing a substantially vibratory action with the combined cyclical lifting and dropping of the material and the rotation of the drum; and permitting the relatively heavy trash to drop through the screen while retaining the remaining material.

2. The method of claim 1 wherein the step of lifting and dropping the material includes the step of balancing the clusters of material on individual finger-shaped baffles to assist in pulling apart the clusters of material.

3. The method of claim 1 further comprising the step of removing air from the material and forming clusters of material prior to lifting and dropping the material.

4. The method of claim 1 further comprising the steps of:

collecting the trash which dropped through the screen; and conveying the trash collected away from the remaining material.

5. The method of claim 1 including the step of adjusting an angle of inclination of the drum with respect to the horizontal.

6. The method of claim 1, further comprising the steps of:

feeding the remaining material to an additional rotatable drum;

lifting and dropping the remaining material over an additional plurality of finger-shaped baffles carried on the inside periphery of the additional drum to further break up clusters of material and separate a further quantity of trash; and permitting the relatively heavy trash of the further quantity of trash to drop through a screen surrounding the additional drum on the furthest inside periphery while retaining the remaining material.

7. An apparatus for removing trash from material comprising:

an elongated drum for receiving the material within the drum;

means for rotating the drum;

said drum including screen means surrounding the drum for allowing heavy trash to drop through; and a plurality of finger-shaped baffles for lifting the material toward an upper portion of the drum and dropping the material directly onto the screen means, each of said baffles comprising an elongated thin rod and being arranged to extend inwardly along a radius of the drum, the plurality of baffles being arranged in two parallel rows disposed 180° apart within the drum and being parallel to each other, whereby the lifting and dropping of the material combined with the rotation of the drum acts similar to a vibratory action.

8. The apparatus of claim 7 wherein each of the baffles is approximately 6 inches long and wherein adjacent baffles are disposed approximately 6 inches apart.

9. The apparatus of claim 7 wherein the drum has an inlet end and an outlet end and wherein the drum is arranged at an angle to a horizontal plane such that the outlet end is lower than the inlet end.

10. The apparatus of claim 9 further comprising means for adjusting the angle of the drum relative to the horizontal plane.

11. The apparatus of claim 7 including means for removing the heavy trash which dropped through the screen means.

12. The apparatus of claim 7 further comprising means for developing a slight negative pressure in a housing surrounding the drum.

13. The apparatus of claim 7, further comprising:

an additional elongated drum;

means for rotating the additional drum;

screen means surrounding the furthest inside periphery of the additional drum for allowing heavy trash to drop through;

an additional plurality of finger-shaped baffles disposed on the furthest inner periphery of the additional drum; and chute means for carrying the material from an outlet of the drum to an inlet of the additional drum.

14. The apparatus of claim 7 wherein the material comprises trash, fiber means, and cotton lint.

15. The apparatus of claim 7 wherein the drum has an inlet end and an outlet end and means for depositing material is provided at the inlet end.

16. The apparatus of claim 15 wherein the means for depositing material comprises cyclone means both for removing air from the material and for forming clusters of material.

* * * * *